United States Patent [19]

Deal

[11] Patent Number: 4,517,754

[45] Date of Patent: May 21, 1985

[54] CUTTERHEAD ATTACHMENT FOR A DREDGE

[76] Inventor: Troy M. Deal, 277 Trismen Ter., Winter Park, Fla. 32789

[21] Appl. No.: 594,197

[22] Filed: Mar. 28, 1984

[51] Int. Cl.[3] ..... E02F 3/88

[52] U.S. Cl. ..... 37/66; 37/189

[58] Field of Search ..... 37/54, 58, 64–67, 37/70, 189

[56] References Cited

U.S. PATENT DOCUMENTS

| | | | |
|---|---|---|---|
| 501,870 | 7/1893 | Collins | 37/66 X |
| 660,956 | 10/1900 | Henderson | 37/66 |
| 1,129,351 | 2/1915 | Lake | 37/54 X |
| 2,807,104 | 9/1957 | Maxey | 37/189 X |
| 3,706,185 | 12/1972 | Chaplin | 56/9 |
| 3,777,375 | 12/1973 | Smith | 37/67 |
| 3,971,148 | 7/1976 | Deal | 37/66 |

FOREIGN PATENT DOCUMENTS

| | | | |
|---|---|---|---|
| 2716312 | 10/1977 | Fed. Rep. of Germany | 37/64 |
| 8950 | 6/1923 | Netherlands | 37/66 |
| 8006270 | 6/1982 | Netherlands | 37/64 |
| 258140 | 12/1970 | U.S.S.R. | 37/67 |

*Primary Examiner*—Clifford D. Crowder

*Attorney, Agent, or Firm*—Beaman & Beaman

[57] ABSTRACT

An attachment for underwater dredging cutterheads mounted above and preceding the cutterhead for digging, breaking up and transferring upland material toward the cutterhead for removal thereby. The attachment includes a shaft above and preceding the dredge suction head having radially extending fingers thereon which engage and disintegrate the upland material and move the material toward the suction head. A hydraulic motor rotates the shaft, and an expansible chamber motor adjusts the shaft vertical position.

12 Claims, 3 Drawing Figures

CUTTERHEAD ATTACHMENT FOR A DREDGE

BACKGROUND OF THE INVENTION

Waterways are commonly formed and cleaned by dredges using suction heads connected to large-capacity high-pressure pumps which draw the waterway spoils into the pump for discharging through pipes at a remote onshore location. The cutting and dredging action of the suction heads is often improved by utilizing rotating cutters within the cutterhead front face, as shown in my U.S. Pat. No. 3,971,148.

While submerged cutterheads are effective to remove spoils and material below the water level, such apparatus encounters difficulty in effectively handling material which extends above the cutterhead front face, particularly when such material comprises "upland" spoils extending above the water surface, as commonly found in swamps and other wetlands. A dredge suction head requires large amounts of water to function and while the submerged cutterhead may extend below upland material, this material often does not crumble and fall into the cutterhead due to vegetation and root structure tending to maintain the integrity of the soil.

It is an object of the invention to provide an attachment for a dredge suction head which permits the suction head to effectively dredge upland material located above the suction head, and even above the water line.

An additional object of the invention is to provide a dredge cutterhead attachment for handling upland material which simultaneously breaks up and pulverizes the upland spoils while conveying the same toward the suction head.

A further object of the invention is to provide a cutterhead attachment for handling upland material wherein the vertical position of the attachment may be readily adjusted in a vertical direction.

In the practice of the invention a bracket is pivotally mounted to the upper portion of a dredge cutterhead at its inner end, and a shaft is rotatably mounted upon the bracket at the outer region thereof. The shaft axis is horizontally disposed and is located forward and above the dredge housing front face substantially parallel thereto. A plurality of radially extending hoe-like fingers are mounted upon the shaft and spade elements are attached to the outer ends of the fingers substantially tangential to the direction of finger movement. A hydraulic rotary motor is attached to the shaft for rotating the shaft and fingers, and an expansible chamber motor is employed to adjust the vertical orientation of the bracket relative to the cutterhead.

The shaft and fingers are rotated in a direction wherein the spades and fingers are brought downwardly into engagement with the upland material for pulverizing and breaking up the same, and as the shaft precedes the suction head front face, the direction of finger movement will move the pulverized upland material toward the dredge front face where it may be further broken up and fed into the head section line for removal. Vertical adjustment of the shaft and fingers by the expansible chamber motor permits the most effective operation of the upland attachment for the particular depth at which the dredge cutterhead is operating.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
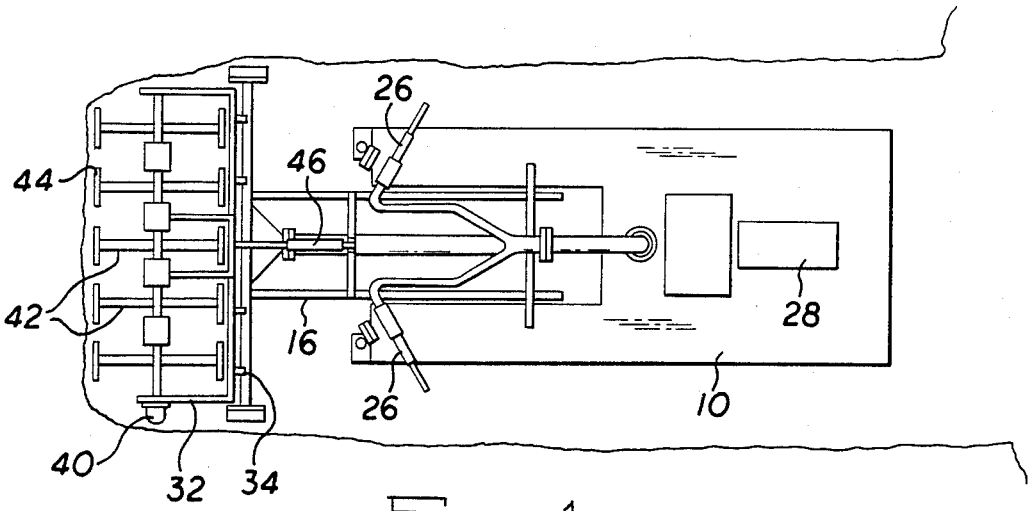
FIG. 1 is a top plan view of a dredge utilizing the cutterhead attachment in accord with the invention.
Figure 2:
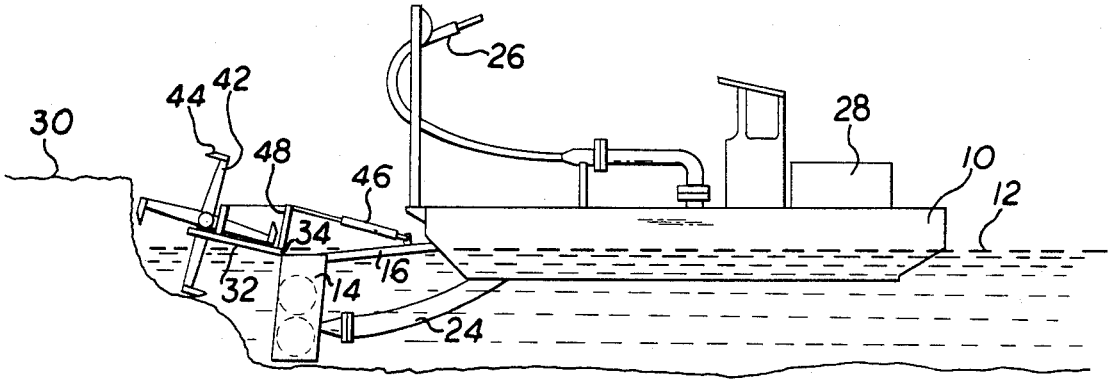
FIG. 2 is a side, elevational view of the dredge and apparatus of the invention.
Figure 3:
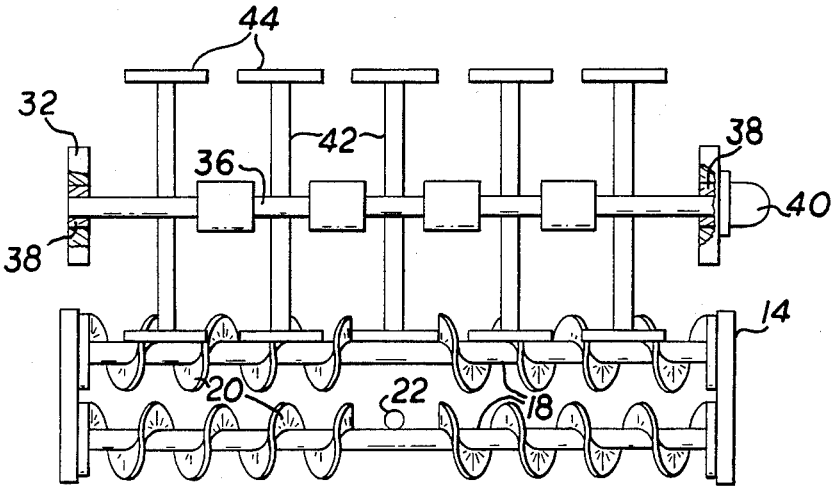
FIG. 3 is a front elevational view of the cutterhead and upland pulverizing apparatus, details of the cutterhead housing being omitted for purpose of illustration.

In FIGS. 1 and 2, typical apparatus with which the invention concepts are employed is shown. A dredge barge 10 floats upon the body of water having a surface at 12, and the dredge supports a cutterhead suction housing 14 at its front end upon supports 16. While the attachment of the invention may be utilized with a wide variety of dredge heads, the dredge head illustrated includes a housing in which a plurality of rotating shafts 18, FIG. 3, are mounted having spiral cutting and transfer elements 20 defined thereon for feeding the spoils entering the cutting head toward the suction outlet 22 wherein the spoils enter the pump suction hose 24. Typical cutterhead apparatus of this type is shown in my U.S. Pat. No. 3,971,148.

After the spoils enter the pump suction hose 24 they may be pumped by pumps located on the barge 10 to an onshore location, as is well known. However, with my invention it is preferred that the dredged material be deposited upon land surrounding the waterway being cleared by means of high-powered jets 26 as described in my copending U.S. patent application Ser. No. 598,805 filed Feb. 17, 1984. Motor 28 mounted upon the barge provides the power for handling the material entering the cutterhead housing.

The attachment in accord with the invention for breaking down the upland material 30 which extends ahead of the cutterhead and above the water level 12 is mounted upon the cutterhead housing 14, although it is to be appreciated that it would be possible to support this apparatus directly from the barge separate from the cutterhead housing. Functionally, the upland housing attachment need only be located above and in front of the cutterhead housing 14.

In the disclosed embodiment the cutterhead attachment includes a bracket 32 having an inner end pivotally attached to the upper region of the cutterhead housing at 34 adjacent the housing front face. The bracket 32 extends forwardly and upwardly from its pivot, and adjacent its outer end rotatably supports the shaft 36 on bearings 38. The shaft 36 is rotated in a counterclockwise direction, FIG. 2, by a rotary hydraulic motor 40 connected to a pressurized hydraulic system on the barge by hose lines and controls, not shown, and of conventional design.

A plurality of radially extending fingers 42 are mounted upon the shaft 36 axially spaced along its length. The outer ends of the fingers each include a spade 44 disposed substantially tangential to the finger outer end direction of movement as the shaft rotates, and preferably, the spades are provided with a sharpened leading edge.

The vertical position of the shaft 36 is adjusted by an expansible chamber motor 46 of the hydraulic type engaging a bracket extension 48, and as the piston of the motor extends and contracts, the bracket 32 will pivot about its pivot 34 raising and lowering the shaft and fingers.

In operation, the cutterhead shafts 18 will be rotating, the barge pump will be pumping, and the shaft 36 and fingers 42 will be rotating due to energization of the motor 40.

As the fingers 42 are fed into the upland material 30, due to the forward motion of the barge, the upland material will be engaged by the spades 44 and fingers, pulverized and the material thrown and fed toward the cutterhead front face for further pulverization and disposal through the suction hose 24. The action of the spades and fingers will loosen and break root structure existing in the upland material, and as the upland material is drawn below the water level, the same may be readily handled by the barge cutterhead as sufficient water is available to permit effective pump operation.

The barge operator is able to visually observe the operation of the finger and spade movement, and with the apparatus of the invention, it is possible for a water channel to be rapidly formed through upland material which previously was impassable by watercraft.

It is appreciated that various modifications to the invention concepts may be apparent to those skilled in the art without departing from the spirit and scope of the invention.

I claim:

1. A dredge suction head comprising, in combination, a cutterhead housing having a front face defining the housing width, an upper portion, and a suction outlet, cutter elements rotatably mounted within said housing front face upon a first horizontally disposed shaft extending across said housing substantially throughout the width thereof, a first motor mounted upon said housing drivingly connected to said shaft supporting said cutter elements, a second horizontally disposed shaft supported forward of and above said front face and extending across the housing width and substantially parallel thereto and to said first shaft, a plurality of radially extending fingers defined on said second shaft extending therefrom, and power means rotating said second shaft in a direction whereby the direction of finger movement below said second shaft is toward said front face and cutter elements and said fingers engage and propel spoils toward said housing front face and cutter elements.

2. In a dredge suction head as in claim 1, said power means comprising a rotary hydraulic motor affixed to said shaft.

3. In a dredge suction head as in claim 1, said fingers each having an outer end, and a spade affixed to each finger outer end.

4. In a dredge suction head as in claim 3, said spades being substantially tangentially related to the direction of movement of said finger's outer ends.

5. In a dredge suction head as in claim 1, a bracket pivotally mounted upon said cutterhead housing, said second shaft being rotatably mounted upon said bracket, and adjustment means connected to said bracket for adjusting the vertical position of said second shaft relative to said housing front face.

6. In a dredge suction head as in claim 5, said adjustment means comprising an expansible chamber motor.

7. An attachment for a dredge suction head having a housing, a front face defining the housing width, an upper portion, a suction outlet and motor driven cutter elements within said front face extending across the housing width comprising, in combination, a bracket having an inner end for pivotal attachment to the head housing upper portion about a horizontal axis and an outer end, a shaft rotatably supported on said bracket outer end for rotation forward and above said front face about a substantially horizontal axis substantially parallel to the housing front face and in alignment with and extending across the housing width, a plurality of radially extending fingers defined on said shaft extending therefrom, and power means rotating said shaft in a direction whereby the direction of finger movement below said shaft is toward said front face and cutter elements and said fingers engage and propel spoils toward said housing front face and cutter elements.

8. In an attachment for a dredge suction head as in claim 7, said power means comprising a rotary hydraulic motor affixed to said shaft.

9. In an attachment for a dredge suction head as in claim 8, said fingers each having an outer end, and a spade affixed to each finger outer end.

10. In an attachment for a dredge suction head as in claim 9, said spades being substantially tangentially related to the direction of movement of said finger's outer ends.

11. In an attachment for a dredge suction head as in claim 7, adjustment means connected to said bracket for pivoting said bracket about said inner end to vertically adjust said shaft.

12. In an attachment for a dredge suction head as in claim 11, said adjustment means comprising an expansible chamber motor.

* * * * *